US008991928B2

(12) United States Patent
Hsieh

(10) Patent No.: US 8,991,928 B2
(45) Date of Patent: Mar. 31, 2015

(54) CONSTRICTING MEMBER OF CHAIR FOOTREST RING

(76) Inventor: Kun-Yu Hsieh, Tainan (TW)

( * ) Notice: Subject to any disclaimer, the term of this patent is extended or adjusted under 35 U.S.C. 154(b) by 214 days.

(21) Appl. No.: 13/616,977

(22) Filed: Sep. 14, 2012

(65) Prior Publication Data

US 2014/0077575 A1 Mar. 20, 2014

(51) Int. Cl.
*A47C 7/50* (2006.01)
*A47C 7/00* (2006.01)

(52) U.S. Cl.
CPC ..... *A47C 7/506* (2013.01); *A47C 7/004* (2013.01)
USPC ..... 297/423.25; 297/451.5; 297/344.19

(58) Field of Classification Search
USPC ..... 297/423.25
See application file for complete search history.

(56) References Cited

U.S. PATENT DOCUMENTS 5,492,430 A * 2/1996 Jones ..... 403/109.5
5,888,200 A * 3/1999 Walen ..... 606/167
5,941,891 A * 8/1999 Walen ..... 606/167
5,988,754 A * 11/1999 Lamart et al. ..... 297/423.38
6,045,564 A * 4/2000 Walen ..... 606/167
6,648,417 B1 * 11/2003 Gilbert et al. ..... 297/423.25
7,387,343 B1 * 6/2008 Hsieh ..... 297/423.38
7,452,034 B2 * 11/2008 Jung ..... 297/423.1
8,057,128 B2 * 11/2011 Stankus et al. ..... 405/302.2
8,146,671 B2 * 4/2012 Sipos ..... 166/380
2010/0102087 A1 * 4/2010 Meike et al. ..... 222/105
2010/0200221 A1 * 8/2010 Sipos ..... 166/250.01
2010/0201177 A1 * 8/2010 Moore ..... 297/423.25
2013/0337983 A1 * 12/2013 McTavish ..... 482/139
2014/0066259 A1 * 3/2014 Andon et al. ..... 482/27

* cited by examiner

*Primary Examiner* — David E Allred
(74) *Attorney, Agent, or Firm* — Rosenberg, Klein & Lee

(57) ABSTRACT

A constricting member of a chair footrest ring is revealed. The constricting member is mainly a constricting sleeve with a hole mounted on a center thereof. A plurality of tapered-shaped mounting and fixing parts is disposed projectingly on an outer surface of the constricting sleeve, from top to bottom and expanded outward. At least one trench is also formed on the outer surface of the constricting sleeve. A positioning projective ring is projecting from and integrally formed on an outer edge on a top end of the constricting sleeve. The structure is simple so that the manufacturing cost is reduced and the assembling is more convenient and faster.

1 Claim, 5 Drawing Sheets

CONSTRICTING MEMBER OF CHAIR FOOTREST RING

BACKGROUND OF THE INVENTION

1. Field of the Invention

The present invention relates to a constricting structure of a chair footrest ring, especially to a constricting member of a chair footrest ring that having simple structure so that not only manufacturing cost is reduced and assembling of the device is also more convenient and faster. The constricting member of a chair footrest ring is of higher practical value.

2. Description of Related Art

No matter at home or in the office, chairs are essentials for our daily lives. For user's comfort after sitting in chairs for a long term, arc-shaped chair seats and backrests are designed according to ergonomics. Thus users will not have pain or discomfort after long term use. Moreover, high chairs are disposed with a footrest ring around a central tube thereof for users' feet to rest thereon comfortably.

Refer to U.S. Pat. No. 7,387,343 "Constricting device for the footrest ring of a chair" granted and published on Jun. 17, 2008, a footrest ring is arranged around a central tube of a chair. A sleeve for mounting the footrest ring on the central tube is taper-shaped and a constricting assembly set between the central tube of the chair and the taper-shaped sleeve of the footrest ring. The constricting assembly includes a main constricting body and a fixing ring which allows the main constricting body and the sleeve of the footrest ring to be fixed and connected with each other. Besides, the main constricting body is taper-shaped corresponding to the taper-shaped sleeve of the footrest ring for connecting with. A hole is disposed on the central part of the main constricting body to allow the central tube of the chair passing through. And the main constricting body is mounted with at least one trench thereon.

Although the above constricting device for a footrest ring of a chair can fix the footrest ring on the central tube of the chair firmly, the design of the constricting assembly including a main constricting body and a fixing ring and used for connecting and positioning the sleeve of the footrest ring makes the structure more complicated. Thus the manufacturing cost is high and the assembly is inconvenient and time-consuming.

There is room for improvement and a need to provide a novel design of a constricting device for a footrest ring of a chair.

SUMMARY OF THE INVENTION

Therefore it is a primary object of the present invention to provide a constricting member of a chair footrest ring in which a constricting sleeve is formed integrally and is used to connect and position a footrest ring in a chair. The structure is simpler and the assembly is more convenient. Thus the manufacturing cost is reduced effectively and the assembly is faster and more convenient. The constricting device of a chair footrest ring is of higher practical value.

In order to achieve the above objet, a constricting member of a chair footrest ring is mainly a constricting sleeve with a hole mounted on a center thereof. A plurality of tapered-shaped mounting and fixing parts is disposed projectingly on an outer surface of the constricting sleeve, from top to bottom and expanded outward. A positioning projective ring is projecting from and integrally formed on an outer edge on a top end of the constricting sleeve.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DESCRIPTION OF THE PREFERRED EMBODIMENT

Figure 1:
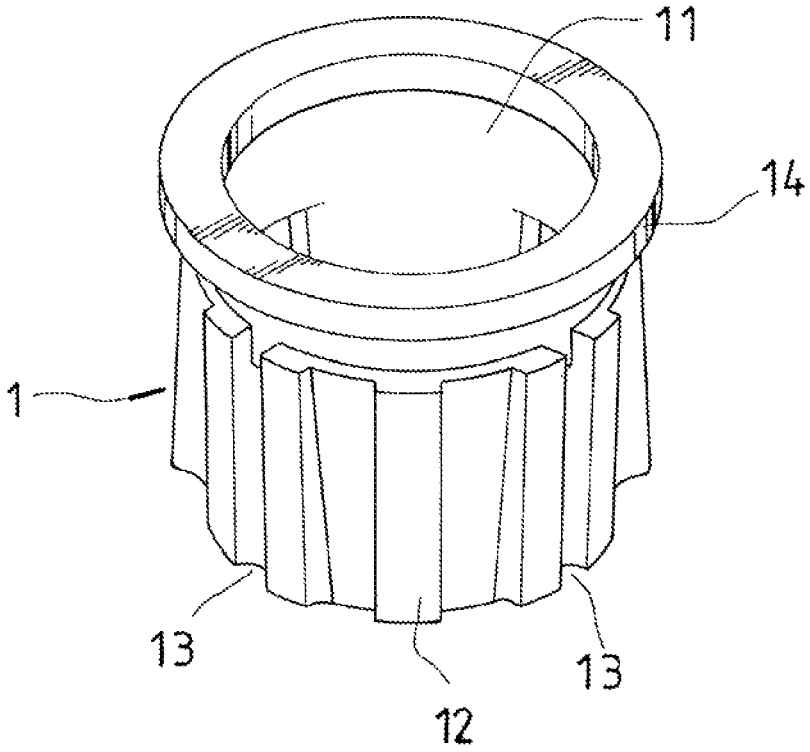
FIG. 1 is a perspective view of an embodiment according to the present invention.
Figure 2:
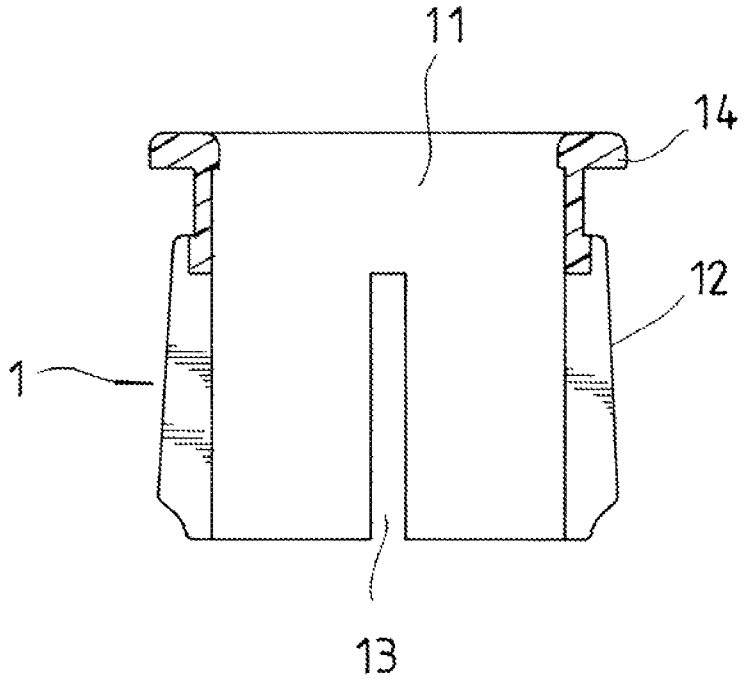
FIG. 2 is a front view of a cross section of an embodiment according to the present invention.
Figure 3:
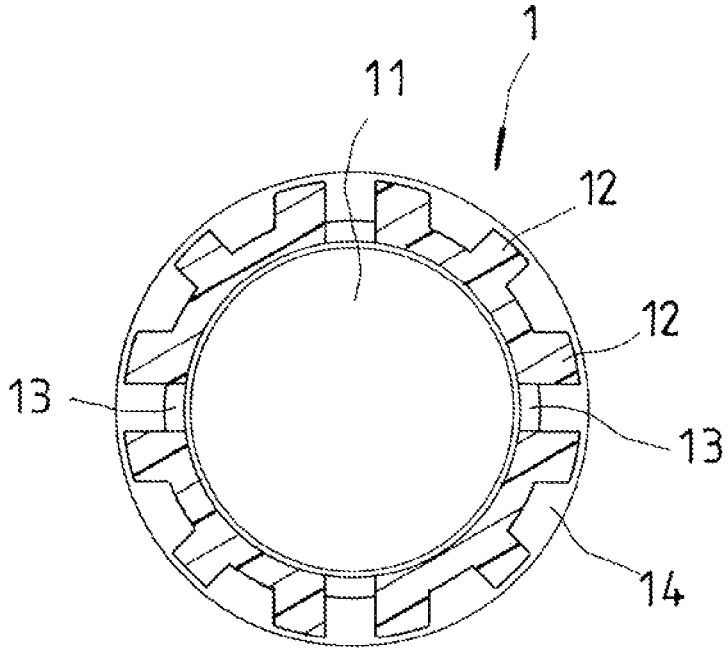
FIG. 3 is a top view of a cross section of an embodiment according to the present invention.

Refer to FIG. 1, FIG. 2, and FIG. 3, a constricting member for a chair footrest ring is a constricting sleeve 1 and a hole 11 is mounted on a center of the constricting sleeve 1. A plurality of tapered-shaped mounting and fixing parts 12 is disposed projectingly on an outer surface of the constricting sleeve 1, from top to bottom and expanded outward. At least one trench 13 is also formed on the outer surface of the constricting sleeve 1. A positioning projective ring 14 is projecting from and integrally formed on an outer edge on a top end of the constricting sleeve 1.

Figure 4:
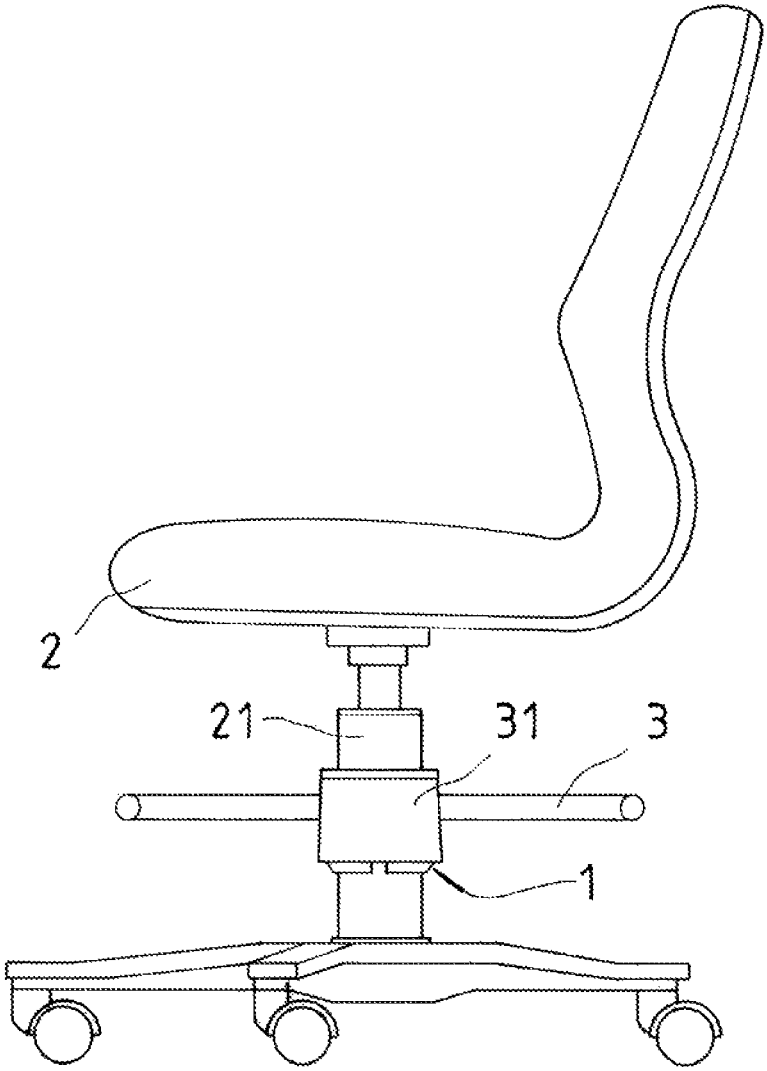
FIG. 4 is a side view of an embodiment in use according to the present invention.
Figure 5:
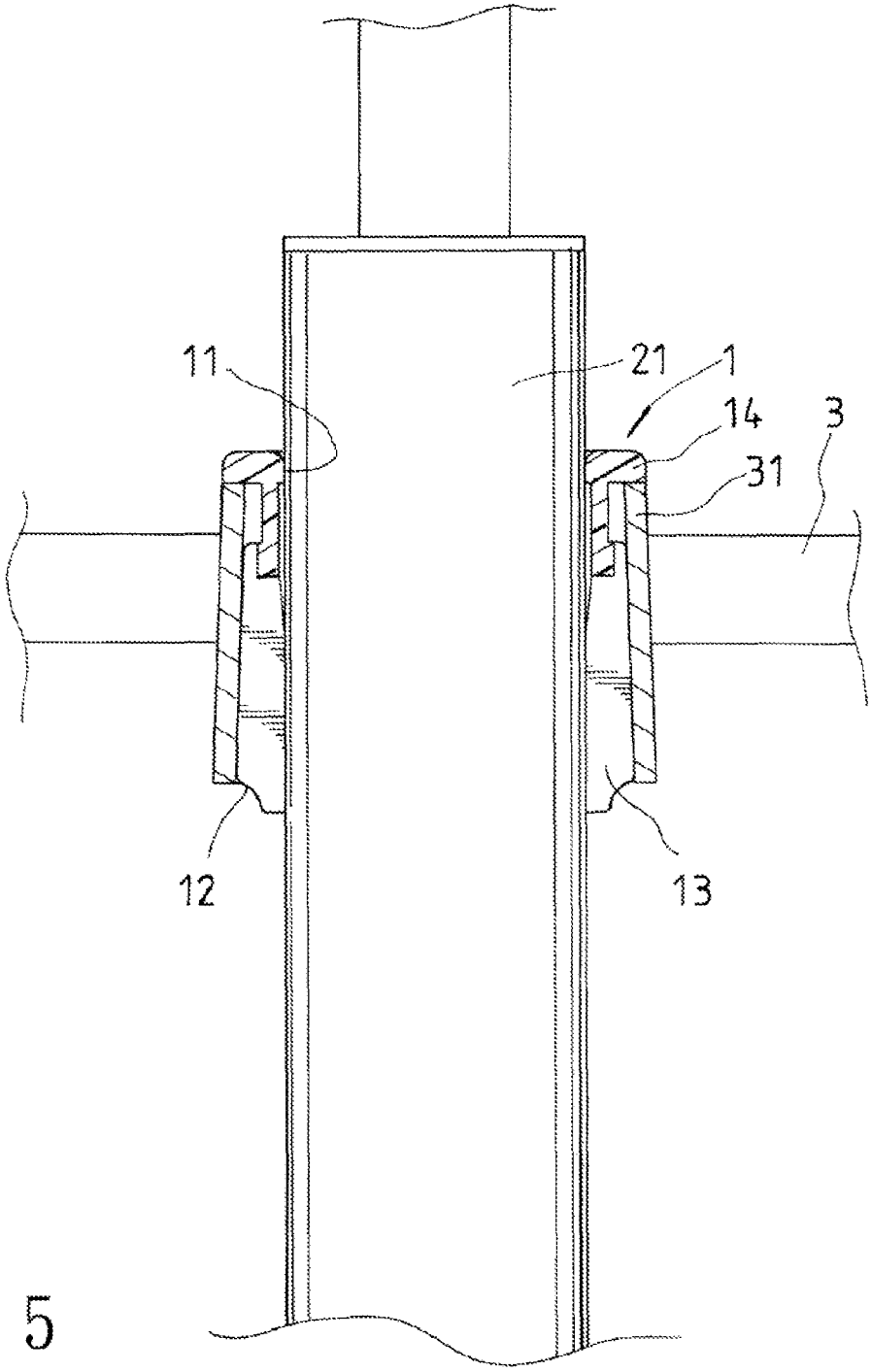
FIG. 5 is a schematic drawing showing a partial cross sectional view of an embodiment in use according to the present invention.

While in use, refer to FIG. 4 and FIG. 5, a central tube 21 of a chair 2 is passed through the hole 11 on the center of the constricting sleeve 1 and a taper-shaped sleeve 31 on a center of a footrest ring 3 is aligned with the constricting sleeve 1 and then is pushed and pressed from top to bottom to be assembled with the constricting sleeve 1. Due to the tapered-shaped of the sleeve 31 of the footrest ring 3, the sleeve 31 is able to pass through the positioning projective ring 14 on top of the constricting sleeve 1 by a certain push-press force. After being moved downward to be sleeved with the mounting and fixing parts 12 around the constricting sleeve 1, the sleeve 31 and the mounting and fixing parts 12 are connected to, mounted and positioned by each other tightly. At the same time, the top end of the sleeve 31 is limited and positioned by the positioning projective ring 14. Thus the footrest ring 3 will not move upward and get loose. Moreover, the mounting and fixing parts 12 of the constricting sleeve 1 can be pressed and constricted more strongly to the central tube 21 of the chair 2 by means of contraction allowance at the trench 13 while being pressed inward by the sleeve 31. Along with a larger force a user applied to the footrest ring 3, the constricting sleeve 1 in the sleeve 31 of the footrest ring 3 is pressed and constricted more severely. Thus the central tube 21 of the chair 2 is pressed and positioned more appropriately by the constricting sleeve 1. Therefore the footrest ring 3 is fixed around the central tube 21 of the chair 2 firmly, not easy to fall off.

In summary, the present invention features on the integrally-formed constricting sleeve compared with conventional structure. The footrest ring is connected to and positioned around the central tube of the chair by the constricting sleeve. The whole structure of the present invention is simpler so that not only the manufacturing cost is reduced significantly and the assembly operation is more convenient and faster. The constricting member is of higher practical value.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A constricting member of a chair footrest ring comprising:

an annular constricting sleeve defining a through-hole extending in an axial direction through a center of the annular constricting sleeve, the through-hole of the annular sleeve receiving a central tube of the chair for supporting the footrest ring on the central tube;

a plurality of tapered-shaped mounting and fixing parts disposed on an outer surface of the constricting sleeve, each of the taper-shaped mounting and fixing parts lengthwise extending axially along the annular constricting sleeve from a top end to a bottom end of the constricting sleeve and expanding in radial projection increasingly outward towards the bottom of the annular constricting sleeve;

each of a plurality of elongated trenches lengthwise extending axially substantially coterminous with and between two adjacent instances of said tapered-shaped mounting and fixing parts, at least one of said trenches formed through the outer surface of the constricting sleeve; and a positioning projective ring that is one piece with and projecting from on an outer edge on the top end of the constricting sleeve.

* * * * *